US010269357B2

(12) United States Patent
Zhang et al.

(10) Patent No.: US 10,269,357 B2
(45) Date of Patent: Apr. 23, 2019

(54) SPEECH/AUDIO BITSTREAM DECODING METHOD AND APPARATUS

(71) Applicant: HUAWEI TECHNOLOGIES CO.,LTD., Shenzhen, Guangdong (CN)

(72) Inventors: Xingtao Zhang, Beijing (CN); Zexin Liu, Beijing (CN); Lei Miao, Beijing (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 168 days.

(21) Appl. No.: 15/256,018

(22) Filed: Sep. 2, 2016

(65) Prior Publication Data

US 2016/0372122 A1 Dec. 22, 2016

Related U.S. Application Data

(63) Continuation of application No. PCT/CN2015/070594, filed on Jan. 13, 2015.

(30) Foreign Application Priority Data

Mar. 21, 2014 (CN) ..... 2014 1 0108478

(51) Int. Cl.
*G10L 19/04* (2013.01)
*G10L 19/005* (2013.01)
(Continued)

(52) U.S. Cl.
CPC ..... *G10L 19/005* (2013.01); *G10L 19/06* (2013.01); *G10L 19/167* (2013.01); *G10L 19/26* (2013.01); *G10L 2019/0002* (2013.01)

(58) Field of Classification Search
CPC ... G10L 19/005; G10L 19/24; G10L 19/0212; G10L 19/0208; G10L 19/265;
(Continued)

(56) References Cited

U.S. PATENT DOCUMENTS 4,731,846 A 3/1988 Secrest et al.
5,615,298 A 3/1997 Chen
(Continued)

FOREIGN PATENT DOCUMENTS

CN 1787078 A 6/2006
CN 101189662 A 5/2008
(Continued)

OTHER PUBLICATIONS

G.729-based embedded variable bit-rate coder: An 8-32 kbit/s scalable widebandcoder bitstream interoperable with G.729. ITU-T Recommendation G.729.1. May 2006. total 100 pages.
(Continued)

*Primary Examiner* — Vijay B Chawan
(74) *Attorney, Agent, or Firm* — Huawei Technologies Co., Ltd.

(57) ABSTRACT

The present invention disclose a speech/audio bitstream decoding method including: acquiring a speech/audio decoding parameter of a current speech/audio frame, where the foregoing current speech/audio frame is a redundant decoded frame or a speech/audio frame previous to the foregoing current speech/audio frame is a redundant decoded frame; performing post processing on the acquired speech/audio decoding parameter according to speech/audio parameters of X speech/audio frames, where the foregoing X speech/audio frames include M speech/audio frames previous to the foregoing current speech/audio frame and/or N speech/audio frames next to the foregoing current speech/audio frame; and recovering a speech/audio signal by using the post-processed speech/audio decoding parameter of the foregoing current speech/audio frame. The technical solutions of the present invention help improve quality of an output speech/audio signal.

17 Claims, 4 Drawing Sheets

(51) Int. Cl.

| | |
|---|---|
| ***G10L 19/06*** | (2013.01) |
| ***G10L 19/16*** | (2013.01) |
| *G10L 19/00* | (2013.01) |
| *G10L 19/26* | (2013.01) |

(58) Field of Classification Search

CPC ..... G10L 21/0232; G10L 19/04; G10L 19/12; G10L 19/167; G10L 19/0017; G10L 19/002; G10L 19/008; G10L 19/0204; G10L 19/022; G10L 19/038; G10L 19/07; G10L 19/19; G10L 19/097; G10L 18/173; G10L 19/18; G10L 19/20; G10L 2019/0005

USPC .... 704/219, 500–504, 230, 229, 200.1, 203, 704/207, 226, 201, 208, 211, 220, 221, 704/223, 225, 228

See application file for complete search history.

(56) References Cited

U.S. PATENT DOCUMENTS 5,699,478 A 12/1997 Nahumi
5,717,824 A 2/1998 Chhatwal
5,907,822 A 5/1999 Prieto, Jr.
6,385,576 B2 5/2002 Amada et al.
6,597,961 B1 7/2003 Cooke
6,665,637 B2 12/2003 Bruhn
6,952,668 B1 10/2005 Kapilow
6,973,425 B1 12/2005 Kapilow
6,985,856 B2 * 1/2006 Wang ..... G10L 19/005 704/226
7,031,926 B2 4/2006 Makinen et al.
7,047,187 B2 5/2006 Cheng et al.
7,069,208 B2 * 6/2006 Wang ..... G10H 1/0058 704/211
7,529,673 B2 5/2009 Makinen et al.
7,590,525 B2 9/2009 Chen
7,693,710 B2 * 4/2010 Jelinek ..... G10L 19/005 704/207
7,933,769 B2 * 4/2011 Bessette ..... G10L 19/0208 375/240.13
7,979,271 B2 * 7/2011 Bessette ..... G10L 19/0208 375/240.13
8,255,207 B2 8/2012 Vaillancourt et al.
8,364,472 B2 1/2013 Ehara
2002/0091523 A1 7/2002 Makinen et al.
2004/0002856 A1 * 1/2004 Bhaskar ..... G10L 19/097 704/219
2004/0117178 A1 6/2004 Ozawa
2004/0128128 A1 * 7/2004 Wang ..... G10L 19/005 704/229
2005/0154584 A1 * 7/2005 Jelinek ..... G10L 19/005 704/219
2005/0207502 A1 9/2005 Ozawa
2006/0088093 A1 4/2006 Lakaniemi et al.
2006/0173687 A1 8/2006 Spindola et al.
2006/0271357 A1 * 11/2006 Wang ..... G10L 19/005 704/223
2007/0225971 A1 * 9/2007 Bessette ..... G10L 19/0208 704/203
2007/0239462 A1 * 10/2007 Makinen ..... G10L 19/005 704/500
2007/0271480 A1 11/2007 Oh et al.
2007/0282603 A1 * 12/2007 Bessette ..... G10L 19/0208 704/219
2008/0195910 A1 * 8/2008 Sung ..... G10L 19/005 714/747
2009/0076808 A1 * 3/2009 Xu ..... G10L 19/005 704/207
2009/0234644 A1 * 9/2009 Reznik ..... G10L 19/24 704/203
2009/0240491 A1 * 9/2009 Reznik ..... G10L 19/24 704/219
2009/0248404 A1 10/2009 Ehara et al.
2010/0057447 A1 * 3/2010 Ehara ..... G10L 19/005 704/219
2010/0115370 A1 5/2010 Laaksonen et al.
2010/0195490 A1 * 8/2010 Nakazawa ..... G10L 19/005 370/216
2010/0312553 A1 * 12/2010 Fang ..... G10L 19/005 704/226
2011/0173010 A1 * 7/2011 Lecomte ..... G10L 19/022 704/500
2011/0173011 A1 * 7/2011 Geiger ..... G10L 19/0212 704/500
2012/0265523 A1 * 10/2012 Greer ..... G10L 19/24 704/201
2013/0028409 A1 1/2013 Li et al.
2013/0096930 A1 * 4/2013 Neuendorf ..... G10L 19/008 704/500
2016/0343382 A1 11/2016 Liu et al.

FOREIGN PATENT DOCUMENTS

CN 101256774 A 9/2008
CN 101261836 A 9/2008
CN 101777963 A 7/2010
CN 101894558 A 11/2010
CN 102105930 A 6/2011
CN 102438152 A 5/2012
CN 102726034 A 10/2012
CN 102760440 A 10/2012
CN 103366749 A 10/2013
CN 104751849 A 7/2015
EP 2017829 A2 1/2009
JP 2003533916 A 11/2003
JP 2004151424 A 5/2004
JP 2004522178 A 7/2004
JP 2005534950 A 11/2005
JP 2009538460 A 11/2009
KR 20080075050 A 8/2008
KR 101833409 B1 2/2018
KR 101839571 B1 3/2018
RU 2437172 C1 12/2011
RU 2459282 C2 8/2012
WO 0063885 A1 10/2000
WO 0186637 A1 11/2001
WO 2004038927 A1 5/2004
WO 2004059894 A3 5/2005
WO 2008007698 A1 1/2008
WO 2008056775 A1 5/2008
WO 2009008220 A1 1/2009
WO 2012158159 A1 11/2012
WO 2013109956 A1 7/2013

OTHER PUBLICATIONS

Recommendation ITU-T G.722. 7 kHz audio-coding within 64 kbit/s. Sep. 2012. total 262 pages.

"Wideband coding of speech at around 16 kbit/s using adaptive multi-rate wideband (amr-wb); G.722.2 appendix 1 ( 01/02); error concealment of erroneous or lost frames", Jan. 13, 2002,XP17400860A, total 18 pages.

Wideband coding of speech at around 16 kbit/s using adaptive multi-rate wideband (amr-wb); G.722.2 ( 07/03); XP17464096A, total 72 pages.

Enhanced Variable Rate Codec, Speech Service Options 3, 68, 70, 73 and 77 for Wideband Spread Spectrum Digital Sytems; 3GPP2 C.S0014-E v1.0 (Dec. 2011); total 358 pages.

ITU-T Recommendation. G.718. Series G: Transmission Systems and Media, Digital Systems and Networks. Digital terminal equipments—Coding of voice and audio signals. Frame error robust narrow-band and wideband embedded variable bit-rate coding of speech and audio from 8-32 kbit/s. Telecommunication Standardization Sector of ITU, Jun. 2008, 257 pages.

Milan Jelinek et al., G.718: A New Embedded Speech and Audio Coding Standard with High Resilience to Error-Prone Transmission

(56) References Cited

OTHER PUBLICATIONS

Channels. ITU-T Standards, IEEE Communications Magazine • Oct. 2009, 7 pages.

* cited by examiner

SPEECH/AUDIO BITSTREAM DECODING METHOD AND APPARATUS

CROSS-REFERENCE TO RELATED APPLICATIONS

This application is a continuation of International Application No. PCT/CN2015/070594, filed on Jan. 13, 2015, which claims priority to Chinese Patent Application No. 201410108478.6, filed with the Chinese Patent Office on Mar. 21, 2014 and entitled "SPEECH/AUDIO BITSTREAM DECODING METHOD AND APPARATUS", both of which are hereby incorporated by reference in their entireties.

TECHNICAL FIELD

The present invention relates to audio decoding technologies, and specifically, to a speech/audio bitstream decoding method and apparatus.

BACKGROUND

In a system based on Voice over Internet Protocol (VoIP, Voice over Internet Protocol), a packet may need to pass through multiple routers in a transmission process, but because these routers may change in a call process, a transmission delay in the call process may change. In addition, when two or more users attempt to enter a network by using a same gateway, a routing delay may change, and such a delay change is called a delay jitter (delay jitter). Similarly, a delay jitter may also be caused when a receiver, a transmitter, a gateway, and the like use a non-real-time operating system, and in a severe situation, a data packet loss occurs, resulting in speech/audio distortion and deterioration of VoIP quality.

Currently, many technologies have been used at different layers of a communication system to reduce a delay, smooth a delay jitter, and perform packet loss compensation. A receiver may use a high-efficiency jitter buffer processing (JBM, Jitter Buffer Management) algorithm to compensate for a network delay jitter to some extent. However, in a case of a relatively high packet loss rate, apparently, a high-quality communication requirement cannot be met only by using the JBM technology.

To help avoid the quality deterioration problem caused by a delay jitter of a speech/audio frame, a redundancy coding algorithm is introduced. That is, in addition to encoding current speech/audio frame information at a particular bit rate, an encoder encodes other speech/audio frame information than the current speech/audio frame at a lower bit rate, and transmits a relatively low bit rate bitstream of the other speech/audio frame information, as redundancy information, to a decoder together with a bitstream of the current speech/audio frame information. When a speech/audio frame is lost, if a jitter buffer buffers or a received bitstream includes redundancy information of the lost speech/audio frame, the decoder recovers the lost speech/audio frame according to the redundancy information, thereby improving speech/audio quality.

In an existing redundancy coding algorithm, in addition to including speech/audio frame information of the $N^{th}$ frame, a bitstream of the $N^{th}$ frame includes speech/audio frame information of the $(N-M)^{th}$ frame at lower bit rate. In a transmission process, if the $(N-M)^{th}$ frame is lost, decoding processing is performed according to the speech/audio frame information that is of the $(N-M)^{th}$ frame and is included in the bitstream of the $N^{th}$ frame, to recover a speech/audio signal of the $(N-M)^{th}$ frame.

It can be learned from the foregoing description that, in the existing redundancy coding algorithm, redundancy bitstream information is obtained by means of encoding at a lower bit rate, which is therefore highly likely to cause signal instability and further cause low quality of an output speech/audio signal.

SUMMARY

Embodiments of the present invention provide a speech/audio bitstream decoding method and apparatus, which help improve quality of an output speech/audio signal.

A first aspect of the embodiments of the present invention provides a speech/audio bitstream decoding method, which may include:

acquiring a speech/audio decoding parameter of a current speech/audio frame, where the current speech/audio frame is a redundant decoded frame or a speech/audio frame previous to the current speech/audio frame is a redundant decoded frame;

performing post processing on the speech/audio decoding parameter of the current speech/audio frame according to speech/audio parameters of X speech/audio frames, to obtain a post-processed speech/audio decoding parameter of the current speech/audio frame, where the X speech/audio frames include M speech/audio frames previous to the current speech/audio frame and/or N speech/audio frames next to the current speech/audio frame, and M and N are positive integers; and recovering a speech/audio signal of the current speech/audio frame by using the post-processed speech/audio decoding parameter of the current speech/audio frame.

A second aspect of the embodiments of the present invention provides a decoder for decoding a speech/audio bitstream, including:

a parameter acquiring unit, configured to acquire a speech/audio decoding parameter of a current speech/audio frame, where the current speech/audio frame is a redundant decoded frame or a speech/audio frame previous to the current speech/audio frame is a redundant decoded frame;

a post processing unit, configured to perform post processing on the speech/audio decoding parameter of the current speech/audio frame according to speech/audio parameters of X speech/audio frames, to obtain a post-processed speech/audio decoding parameter of the current speech/audio frame, where the X speech/audio frames include M speech/audio frames previous to the current speech/audio frame and/or N speech/audio frames next to the current speech/audio frame, and M and N are positive integers; and a recovery unit, configured to recover a speech/audio signal of the current speech/audio frame by using the post-processed speech/audio decoding parameter of the current speech/audio frame.

A third aspect of the embodiments of the present invention provides a computer storage medium, where the computer storage medium may store a program, and when being executed, the program includes some or all steps of any speech/audio bitstream decoding method described in the embodiments of the present invention.

It can be learned that in some embodiments of the present invention, in a scenario in which a current speech/audio frame is a redundant decoded frame or a speech/audio frame previous to the current speech/audio frame is a redundant decoded frame, after obtaining a speech/audio decoding parameter of the current speech/audio frame, a decoder performs post processing on the speech/audio decoding parameter of the current speech/audio frame according to speech/audio parameters of X speech/audio frames, to obtain a post-processed speech/audio decoding parameter of the current speech/audio frame, where the foregoing X speech/audio frames include M speech/audio frames previous to the foregoing current speech/audio frame and/or N speech/audio frames next to the foregoing current speech/audio frame, and recovers a speech/audio signal of the current speech/audio frame by using the post-processed speech/audio decoding parameter of the current speech/audio frame, which ensures stable quality of a decoded signal during transition between a redundant decoded frame and a normal decoded frame or between a redundant decoded frame and a frame erasure concealment (FEC, Frame erasure concealment) recovered frame, thereby improving quality of an output speech/audio signal.

BRIEF DESCRIPTION OF DRAWINGS

To describe the technical solutions in the embodiments of the present invention more clearly, the following briefly describes the accompanying drawings required for describing the embodiments. Apparently, the accompanying drawings in the following description show merely some embodiments of the present invention, and persons of ordinary skill in the art may still derive other drawings from these accompanying drawings without creative efforts.

DESCRIPTION OF EMBODIMENTS

Embodiments of the present invention provide a speech/audio bitstream decoding method and apparatus, which help improve quality of an output speech/audio signal.

To make the invention objectives, features, and advantages of the present invention clearer and more comprehensible, the following clearly describes the technical solutions in the embodiments of the present invention with reference to the accompanying drawings in the embodiments of the present invention. Apparently, the embodiments described in the following are merely a part rather than all of the embodiments of the present invention. All other embodiments obtained by persons of ordinary skill in the art based on the embodiments of the present invention without creative efforts shall fall within the protection scope of the present invention.

In the specification, claims, and accompanying drawings of the present invention, the terms "first", "second", "third", "fourth", and so on are intended to distinguish between different objects but not to indicate a particular order. In addition, the terms "including", "including", or any other variant thereof, are intended to cover a non-exclusive inclusion. For example, a process, a method, a system, a product, or a device including a series of steps or units is not limited to the listed steps or units, and may include steps or units that are not listed.

The following gives respective descriptions in details.

The speech/audio bitstream decoding method provided in the embodiments of the present invention is first described. The speech/audio bitstream decoding method provided in the embodiments of the present invention is executed by a decoder, where the decoder may be any apparatus that needs to output speeches, for example, a device such as a mobile phone, a notebook computer, a tablet computer, or a personal computer.

In an embodiment of the speech/audio bitstream decoding method in the present invention, the speech/audio bitstream decoding method may include: acquiring a speech/audio decoding parameter of a current speech/audio frame, where the foregoing current speech/audio frame is a redundant decoded frame or a speech/audio frame previous to the foregoing current speech/audio frame is a redundant decoded frame; performing post processing on the speech/audio decoding parameter of the foregoing current speech/audio frame according to speech/audio parameters of X speech/audio frames, to obtain a post-processed speech/audio decoding parameter of the foregoing current speech/audio frame, where the foregoing X speech/audio frames include M speech/audio frames previous to the foregoing current speech/audio frame and/or N speech/audio frames next to the foregoing current speech/audio frame, and M and N are positive integers; and recovering a speech/audio signal of the foregoing current speech/audio frame by using the post-processed speech/audio decoding parameter of the foregoing current speech/audio frame.

Figure 1:
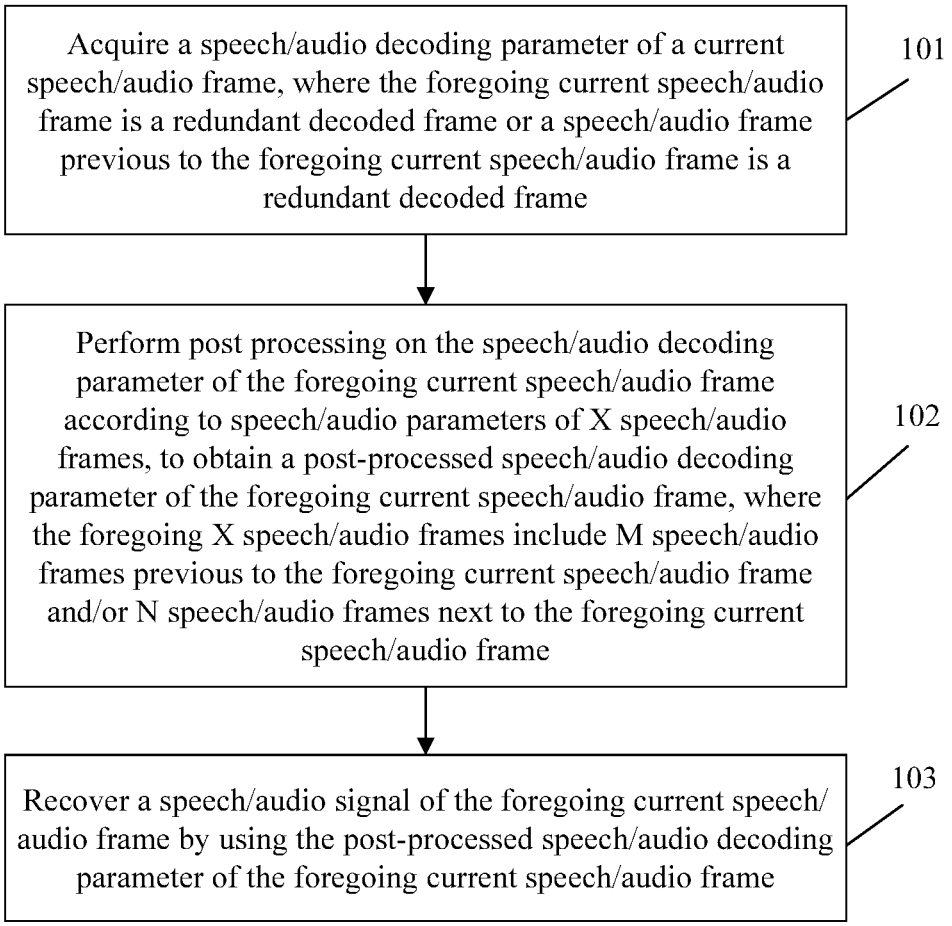
FIG. 1 is a schematic flowchart of a speech/audio bitstream decoding method according to an embodiment of the present invention.

FIG. 1 is a schematic flowchart of a speech/audio bitstream decoding method according to an embodiment of the present invention. The speech/audio bitstream decoding method provided in this embodiment of the present invention may include the following content:

101. Acquire a speech/audio decoding parameter of a current speech/audio frame.

The foregoing current speech/audio frame is a redundant decoded frame or a speech/audio frame previous to the foregoing current speech/audio frame is a redundant decoded frame.

When the speech/audio frame previous to the foregoing current speech/audio frame is a redundant decoded frame, the current speech/audio frame may be a normal decoded frame, an FEC recovered frame, or a redundant decoded frame, where if the current speech/audio frame is an FEC recovered frame, the speech/audio decoding parameter of the current speech/audio frame may be predicated based on an FEC algorithm.

102. Perform post processing on the speech/audio decoding parameter of the foregoing current speech/audio frame according to speech/audio parameters of X speech/audio frames, to obtain a post-processed speech/audio decoding parameter of the foregoing current speech/audio frame, where the foregoing X speech/audio frames include M speech/audio frames previous to the foregoing current speech/audio frame and/or N speech/audio frames next to the foregoing current speech/audio frame, and M and N are positive integers.

That a speech/audio frame (for example, the current speech/audio frame or the speech/audio frame previous to the current speech/audio frame) is a normal decoded frame means that a speech/audio parameter of the foregoing speech/audio frame can be directly obtained from a bitstream of the speech/audio frame by means of decoding.

That a speech/audio frame (for example, a current speech/audio frame or a speech/audio frame previous to a current speech/audio frame) is a redundant decoded frame means that a speech/audio parameter of the speech/audio frame cannot be directly obtained from a bitstream of the speech/audio frame by means of decoding, but redundant bitstream information of the speech/audio frame can be obtained from a bitstream of another speech/audio frame.

The M speech/audio frames previous to the current speech/audio frame refer to M speech/audio frames preceding the current speech/audio frame and immediately adjacent to the current speech/audio frame in a time domain.

For example, M may be equal to 1, 2, 3, or another value. When M=1, the M speech/audio frames previous to the current speech/audio frame are the speech/audio frame previous to the current speech/audio frame, and the speech/audio frame previous to the current speech/audio frame and the current speech/audio frame are two immediately adjacent speech/audio frames; when M=2, the M speech/audio frames previous to the current speech/audio frame are the speech/audio frame previous to the current speech/audio frame and a speech/audio frame previous to the speech/audio frame previous to the current speech/audio frame, and the speech/audio frame previous to the current speech/audio frame, the speech/audio frame previous to the speech/audio frame previous to the current speech/audio frame, and the current speech/audio frame are three immediately adjacent speech/audio frames; and so on.

The N speech/audio frames next to the current speech/audio frame refer to N speech/audio frames following the current speech/audio frame and immediately adjacent to the current speech/audio frame in a time domain.

For example, N may be equal to 1, 2, 3, 4, or another value. When N=1, the N speech/audio frames next to the current speech/audio frame are a speech/audio frame next to the current speech/audio frame, and the speech/audio frame next to the current speech/audio frame and the current speech/audio frame are two immediately adjacent speech/audio frames; when N=2, the N speech/audio frames next to the current speech/audio frame are a speech/audio frame next to the current speech/audio frame and a speech/audio frame next to the speech/audio frame next to the current speech/audio frame, and the speech/audio frame next to the current speech/audio frame, the speech/audio frame next to the speech/audio frame next to the current speech/audio frame, and the current speech/audio frame are three immediately adjacent speech/audio frames; and so on.

The speech/audio decoding parameter may include at least one of the following parameters:

a bandwidth extension envelope, an adaptive codebook gain (gain_pit), an algebraic codebook, a pitch period, a spectrum tilt factor, a spectral pair parameter, and the like.

The speech/audio parameter may include a speech/audio decoding parameter, a signal class, and the like.

A signal class of a speech/audio frame may be unvoiced (UNVOICED), voiced (VOICED), generic (GENERIC), transient (TRANSIENT), inactive (INACTIVE), or the like.

The spectral pair parameter may be, for example, at least one of a line spectral pair (LSP: Line Spectral Pair) parameter or an immittance spectral pair (ISP: Immittance Spectral Pair) parameter.

It may be understood that in this embodiment of the present invention, post processing may be performed on at least one speech/audio decoding parameter of a bandwidth extension envelope, an adaptive codebook gain, an algebraic codebook, a pitch period, or a spectral pair parameter of the current speech/audio frame. Specifically, how many parameters are selected and which parameters are selected for post processing may be determined according to an application scenario and an application environment, which is not limited in this embodiment of the present invention.

Different post processing may be performed on different speech/audio decoding parameters. For example, post processing performed on the spectral pair parameter of the current speech/audio frame may be adaptive weighting performed by using the spectral pair parameter of the current speech/audio frame and a spectral pair parameter of the speech/audio frame previous to the current speech/audio frame, to obtain a post-processed spectral pair parameter of the current speech/audio frame, and post processing performed on the adaptive codebook gain of the current speech/audio frame may be adjustment such as attenuation performed on the adaptive codebook gain.

A specific post processing manner is not limited in this embodiment of the present invention, and specific post processing may be set according to a requirement or according to an application environment and an application scenario.

103. Recover a speech/audio signal of the foregoing current speech/audio frame by using the post-processed speech/audio decoding parameter of the foregoing current speech/audio frame.

It can be learned from the foregoing description that in this embodiment, in a scenario in which a current speech/audio frame is a redundant decoded frame or a speech/audio frame previous to the foregoing current speech/audio frame is a redundant decoded frame, after obtaining a speech/audio decoding parameter of the current speech/audio frame, a decoder performs post processing on the speech/audio decoding parameter of the current speech/audio frame according to speech/audio parameters of X speech/audio frames, to obtain a post-processed speech/audio decoding parameter of the foregoing current speech/audio frame, where the foregoing X speech/audio frames include M speech/audio frames previous to the foregoing current speech/audio frame and/or N speech/audio frames next to the foregoing current speech/audio frame, and recovers a speech/audio signal of the current speech/audio frame by using the post-processed speech/audio decoding parameter of the current speech/audio frame, which ensures stable quality of a decoded signal during transition between a redundant decoded frame and a normal decoded frame or between a redundant decoded frame and an FEC recovered frame, thereby improving quality of an output speech/audio signal.

In some embodiments of the present invention, the speech/audio decoding parameter of the foregoing current speech/audio frame includes the spectral pair parameter of the foregoing current speech/audio frame, and the performing post processing on the speech/audio decoding parameter of the foregoing current speech/audio frame according to speech/audio parameters of X speech/audio frames, to obtain a post-processed speech/audio decoding parameter of the foregoing current speech/audio frame, for example, may include: performing post processing on the spectral pair parameter of the foregoing current speech/audio frame according to at least one of a signal class, a spectrum tilt factor, an adaptive codebook gain, or a spectral pair parameter of the X speech/audio frames, to obtain a post-processed spectral pair parameter of the foregoing current speech/audio frame.

For example, the performing post processing on the spectral pair parameter of the foregoing current speech/audio frame according to at least one of a signal class, a spectrum tilt factor, an adaptive codebook gain, or a spectral pair parameter of the X speech/audio frames, to obtain a post-processed spectral pair parameter of the foregoing current speech/audio frame may include:

if the foregoing current speech/audio frame is a normal decoded frame, the speech/audio frame previous to the foregoing current speech/audio frame is a redundant decoded frame, a signal class of the foregoing current speech/audio frame is unvoiced, and a signal class of the speech/audio frame previous to the foregoing current speech/audio frame is not unvoiced, using the spectral pair parameter of the foregoing current speech/audio frame as the post-processed spectral pair parameter of the foregoing current speech/audio frame, or obtaining the post-processed spectral pair parameter of the foregoing current speech/audio frame based on the spectral pair parameter of the foregoing current speech/audio frame; or if the foregoing current speech/audio frame is a normal decoded frame, the speech/audio frame previous to the foregoing current speech/audio frame is a redundant decoded frame, a signal class of the foregoing current speech/audio frame is unvoiced, and a signal class of the speech/audio frame previous to the foregoing current speech/audio frame is not unvoiced, obtaining the post-processed spectral pair parameter of the foregoing current speech/audio frame based on the spectral pair parameter of the current speech/audio frame and a spectral pair parameter of the speech/audio frame previous to the foregoing current speech/audio frame; or if the foregoing current speech/audio frame is a redundant decoded frame, a signal class of the foregoing current speech/audio frame is not unvoiced, and a signal class of a speech/audio frame next to the foregoing current speech/audio frame is unvoiced, using a spectral pair parameter of the speech/audio frame previous to the foregoing current speech/audio frame as the post-processed spectral pair parameter of the foregoing current speech/audio frame, or obtaining the post-processed spectral pair parameter of the foregoing current speech/audio frame based on a spectral pair parameter of the speech/audio frame previous to the foregoing current speech/audio frame; or if the foregoing current speech/audio frame is a redundant decoded frame, a signal class of the foregoing current speech/audio frame is not unvoiced, and a signal class of a speech/audio frame next to the foregoing current speech/audio frame is unvoiced, obtaining the post-processed spectral pair parameter of the foregoing current speech/audio frame based on the spectral pair parameter of the foregoing current speech/audio frame and a spectral pair parameter of the speech/audio frame previous to the foregoing current speech/audio frame; or if the foregoing current speech/audio frame is a redundant decoded frame, a signal class of the foregoing current speech/audio frame is not unvoiced, a maximum value of an adaptive codebook gain of a subframe in a speech/audio frame next to the foregoing current speech/audio frame is less than or equal to a first threshold, and a spectrum tilt factor of the speech/audio frame previous to the foregoing current speech/audio frame is less than or equal to a second threshold, using a spectral pair parameter of the speech/audio frame previous to the foregoing current speech/audio frame as the post-processed spectral pair parameter of the foregoing current speech/audio frame, or obtaining the post-processed spectral pair parameter of the foregoing current speech/audio frame based on a spectral pair parameter of the speech/audio frame previous to the foregoing current speech/audio frame; or if the foregoing current speech/audio frame is a redundant decoded frame, a signal class of the foregoing current speech/audio frame is not unvoiced, a maximum value of an adaptive codebook gain of a subframe in a speech/audio frame next to the foregoing current speech/audio frame is less than or equal to a first threshold, and a spectrum tilt factor of the speech/audio frame previous to the foregoing current speech/audio frame is less than or equal to a second threshold, obtaining the post-processed spectral pair parameter of the foregoing current speech/audio frame based on the spectral pair parameter of the current speech/audio frame and a spectral pair parameter of the speech/audio frame previous to the foregoing current speech/audio frame; or if the foregoing current speech/audio frame is a redundant decoded frame, a signal class of the foregoing current speech/audio frame is not unvoiced, a speech/audio frame next to the foregoing current speech/audio frame is unvoiced, a maximum value of an adaptive codebook gain of a subframe in the speech/audio frame next to the foregoing current speech/audio frame is less than or equal to a third threshold, and a spectrum tilt factor of the speech/audio frame previous to the foregoing current speech/audio frame is less than or equal to a fourth threshold, using a spectral pair parameter of the speech/audio frame previous to the foregoing current speech/audio frame as the post-processed spectral pair parameter of the foregoing current speech/audio frame, or obtaining the post-processed spectral pair parameter of the foregoing current speech/audio frame based on a spectral pair parameter of the speech/audio frame previous to the foregoing current speech/audio frame; or if the foregoing current speech/audio frame is a redundant decoded frame, a signal class of the foregoing current speech/audio frame is not unvoiced, a signal class of a speech/audio frame next to the foregoing current speech/audio frame is unvoiced, a maximum value of an adaptive codebook gain of a subframe in the speech/audio frame next to the foregoing current speech/audio frame is less than or equal to a third threshold, and a spectrum tilt factor of the speech/audio frame previous to the foregoing current speech/audio frame is less than or equal to a fourth threshold, obtaining the post-processed spectral pair parameter of the foregoing current speech/audio frame based on the spectral pair parameter of the foregoing current speech/audio frame and a spectral pair parameter of the speech/audio frame previous to the foregoing current speech/audio frame.

There may be various manners for obtaining the post-processed spectral pair parameter of the foregoing current speech/audio frame based on the spectral pair parameter of the foregoing current speech/audio frame and a spectral pair parameter of the speech/audio frame previous to the foregoing current speech/audio frame.

For example, the obtaining the post-processed spectral pair parameter of the foregoing current speech/audio frame based on the spectral pair parameter of the foregoing current speech/audio frame and a spectral pair parameter of the speech/audio frame previous to the foregoing current speech/audio frame may include: specifically obtaining the post-processed spectral pair parameter of the foregoing current speech/audio frame based on the spectral pair parameter of the foregoing current speech/audio frame and the spectral pair parameter of the speech/audio frame previous to the foregoing current speech/audio frame and by using the following formula:

$$lsp[k]=\alpha*lsp_\mathrm{old}[k]+\beta*lsp_\mathrm{mid}[k]+\delta*lsp_\mathrm{new}[k]$$
$$0\le k\le L,$$

where lsp[k] is the post-processed spectral pair parameter of the foregoing current speech/audio frame, lsp_old[k] is the spectral pair parameter of the speech/audio frame previous to the foregoing current speech/audio frame, lsp_mid[k] is a middle value of the spectral pair parameter of the foregoing current speech/audio frame, lsp_new[k] is the spectral pair parameter of the foregoing current speech/audio frame, L is an order of a spectral pair parameter, $\alpha$ is a weight of the spectral pair parameter of the speech/audio frame previous to the foregoing current speech/audio frame, $\beta$ is a weight of the middle value of the spectral pair parameter of the foregoing current speech/audio frame, $\delta$ is a weight of the spectral pair parameter of the foregoing current speech/audio frame, $\alpha \geq 0$, $\beta \geq 0$, $\delta \geq 0$, and $\alpha \pm \beta \pm \delta = 1$, where if the foregoing current speech/audio frame is a normal decoded frame, and the speech/audio frame previous to the foregoing current speech/audio frame is a redundant decoded frame, $\alpha$ is equal to 0 or $\alpha$ is less than or equal to a fifth threshold; or if the foregoing current speech/audio frame is a redundant decoded frame, $\beta$ is equal to 0 or $\beta$ is less than or equal to a sixth threshold; or if the foregoing current speech/audio frame is a redundant decoded frame, $\delta$ is equal to 0 or $\delta$ is less than or equal to a seventh threshold; or if the foregoing current speech/audio frame is a redundant decoded frame, $\beta$ is equal to 0 or $\beta$ is less than or equal to a sixth threshold, and $\delta$ is equal to 0 or $\delta$ is less than or equal to a seventh threshold.

For another example, the obtaining the post-processed spectral pair parameter of the foregoing current speech/audio frame based on the spectral pair parameter of the foregoing current speech/audio frame and a spectral pair parameter of the speech/audio frame previous to the foregoing current speech/audio frame may include: specifically obtaining the post-processed spectral pair parameter of the foregoing current speech/audio frame based on the spectral pair parameter of the foregoing current speech/audio frame and the spectral pair parameter of the speech/audio frame previous to the foregoing current speech/audio frame and by using the following formula:

$$lsp[k]=\alpha*lsp_\mathrm{old}[k]+\delta*lsp_\mathrm{new}[k] \quad 0 \leq k \leq L, \text{ where}$$

lsp[k] is the post-processed spectral pair parameter of the foregoing current speech/audio frame, lsp_old[k] is the spectral pair parameter of the speech/audio frame previous to the foregoing current speech/audio frame, lsp_new[k] is the spectral pair parameter of the foregoing current speech/audio frame, L is an order of a spectral pair parameter, $\alpha$ is a weight of the spectral pair parameter of the speech/audio frame previous to the foregoing current speech/audio frame, $\delta$ is a weight of the spectral pair parameter of the foregoing current speech/audio frame, $\alpha \geq 0$, $\delta \geq 0$, and $\alpha + \delta = 1$, where if the foregoing current speech/audio frame is a normal decoded frame, and the speech/audio frame previous to the foregoing current speech/audio frame is a redundant decoded frame, $\alpha$ is equal to 0 or $\alpha$ is less than or equal to a fifth threshold; or if the foregoing current speech/audio frame is a redundant decoded frame, $\delta$ is equal to 0 or $\delta$ is less than or equal to a seventh threshold.

The fifth threshold, the sixth threshold, and the seventh threshold each may be set to different values according to different application environments or scenarios. For example, a value of the fifth threshold may be close to 0, where for example, the fifth threshold may be equal to 0.001, 0.002, 0.01, 0.1, or another value close to 0; a value of the sixth threshold may be close to 0, where for example, the sixth threshold may be equal to 0.001, 0.002, 0.01, 0.1, or another value close to 0; and a value of the seventh threshold may be close to 0, where for example, the seventh threshold may be equal to 0.001, 0.002, 0.01, 0.1, or another value close to 0.

The first threshold, the second threshold, the third threshold, and the fourth threshold each may be set to different values according to different application environments or scenarios.

For example, the first threshold may be set to 0.9, 0.8, 0.85, 0.7, 0.89, or 0.91.

For example, the second threshold may be set to 0.16, 0.15, 0.165, 0.1, 0.161, or 0.159.

For example, the third threshold may be set to 0.9, 0.8, 0.85, 0.7, 0.89, or 0.91.

For example, the fourth threshold may be set to 0.16, 0.15, 0.165, 0.1, 0.161, or 0.159.

The first threshold may be equal to or not equal to the third threshold, and the second threshold may be equal to or not equal to the fourth threshold.

In other embodiments of the present invention, the speech/audio decoding parameter of the foregoing current speech/audio frame includes the adaptive codebook gain of the foregoing current speech/audio frame, and the performing post processing on the speech/audio decoding parameter of the foregoing current speech/audio frame according to speech/audio parameters of X speech/audio frames, to obtain a post-processed speech/audio decoding parameter of the foregoing current speech/audio frame may include: performing post processing on the adaptive codebook gain of the foregoing current speech/audio frame according to at least one of the signal class, an algebraic codebook gain, or the adaptive codebook gain of the X speech/audio frames, to obtain a post-processed adaptive codebook gain of the foregoing current speech/audio frame.

For example, the performing post processing on the adaptive codebook gain of the foregoing current speech/audio frame according to at least one of the signal class, an algebraic codebook gain, or the adaptive codebook gain of the X speech/audio frames may include:

if the foregoing current speech/audio frame is a redundant decoded frame, the signal class of the foregoing current speech/audio frame is not unvoiced, a signal class of at least one of two speech/audio frames next to the foregoing current speech/audio frame is unvoiced, and an algebraic codebook gain of a current subframe of the foregoing current speech/audio frame is greater than or equal to an algebraic codebook gain of the speech/audio frame previous to the foregoing current speech/audio frame (for example, the algebraic codebook gain of the current subframe of the foregoing current speech/audio frame is 1 or more than 1 time, for example, 1, 1.5, 2, 2.5, 3, 3.4, or 4 times, the algebraic codebook gain of the speech/audio frame previous to the foregoing current speech/audio frame, attenuating an adaptive codebook gain of the foregoing current subframe; or if the foregoing current speech/audio frame is a redundant decoded frame, the signal class of the foregoing current speech/audio frame is not unvoiced, a signal class of at least one of the speech/audio frame next to the foregoing current speech/audio frame or a speech/audio frame next to the next speech/audio frame is unvoiced, and an algebraic codebook gain of a current subframe of the foregoing current speech/audio frame is greater than or equal to an algebraic codebook gain of a subframe previous to the foregoing current subframe (for example, the algebraic codebook gain of the current subframe of the foregoing current speech/audio frame is 1 or more than 1 time, for example, 1, 1.5, 2, 2.5, 3, 3.4, or 4 times, the algebraic codebook gain of the subframe previous to the foregoing current subframe), attenuating an adaptive codebook gain of the foregoing current subframe; or if the foregoing current speech/audio frame is a redundant decoded frame, or the foregoing current speech/audio frame is a normal decoded frame, and the speech/audio frame previous to the foregoing current speech/audio frame is a redundant decoded frame, and if the signal class of the foregoing current speech/audio frame is generic, the signal class of the speech/audio frame next to the foregoing current speech/audio frame is voiced, and an algebraic codebook gain of a subframe of the foregoing current speech/audio frame is greater than or equal to an algebraic codebook gain of a subframe previous to the foregoing subframe (for example, the algebraic codebook gain of the subframe of the foregoing current speech/audio frame may be 1 or more than 1 time, for example, 1, 1.5, 2, 2.5, 3, 3.4, or 4 times, the algebraic codebook gain of the subframe previous to the foregoing subframe), adjusting (for example, augmenting or attenuating) an adaptive codebook gain of a current subframe of the foregoing current speech/audio frame based on at least one of a ratio of an algebraic codebook gain of the current subframe of the foregoing current speech/audio frame to that of a subframe adjacent to the foregoing current subframe, a ratio of the adaptive codebook gain of the current subframe of the foregoing current speech/audio frame to that of the subframe adjacent to the foregoing current subframe, or a ratio of the algebraic codebook gain of the current subframe of the foregoing current speech/audio frame to that of the speech/audio frame previous to the foregoing current speech/audio frame (for example, if the ratio of the algebraic codebook gain of the current subframe of the foregoing current speech/audio frame to that of the subframe adjacent to the foregoing current subframe is greater than or equal to an eleventh threshold (where the eleventh threshold may be equal to, for example, 2, 2.1, 2.5, 3, or another value), the ratio of the adaptive codebook gain of the current subframe of the foregoing current speech/audio frame to that of the subframe adjacent to the foregoing current subframe is greater than or equal to a twelfth threshold (where the twelfth threshold may be equal to, for example, 1, 1.1, 1.5, 2, 2.1, or another value), and the ratio of the algebraic codebook gain of the current subframe of the foregoing current speech/audio frame to that of the speech/audio frame previous to the foregoing current speech/audio frame is less than or equal to a thirteenth threshold (where the thirteenth threshold may be equal to, for example, 1, 1.1, 1.5, 2, or another value), the adaptive codebook gain of the current subframe of the foregoing current speech/audio frame may be augmented); or if the foregoing current speech/audio frame is a redundant decoded frame, or the foregoing current speech/audio frame is a normal decoded frame, and the speech/audio frame previous to the foregoing current speech/audio frame is a redundant decoded frame, and if the signal class of the foregoing current speech/audio frame is generic, the signal class of the speech/audio frame next to the foregoing current speech/audio frame is voiced, and an algebraic codebook gain of a subframe of the foregoing current speech/audio frame is greater than or equal to an algebraic codebook gain of the speech/audio frame previous to the foregoing current speech/audio frame (where the algebraic codebook gain of the subframe of the foregoing current speech/audio frame is 1 or more than 1 time, for example, 1, 1.5, 2, 2.5, 3, 3.4, or 4 times, the algebraic codebook gain of the speech/audio frame previous to the foregoing current speech/audio frame), adjusting (attenuating or augmenting) an adaptive codebook gain of a current subframe of the foregoing current speech/audio frame based on at least one of a ratio of an algebraic codebook gain of the current subframe of the foregoing current speech/audio frame to that of a subframe adjacent to the foregoing current subframe, a ratio of the adaptive codebook gain of the current subframe of the foregoing current speech/audio frame to that of the subframe adjacent to the foregoing current subframe, or a ratio of the algebraic codebook gain of the current subframe of the foregoing current speech/audio frame to that of the speech/audio frame previous to the foregoing current speech/audio frame (for example, if the ratio of the algebraic codebook gain of the current subframe of the foregoing current speech/audio frame to that of the subframe adjacent to the foregoing current subframe is greater than or equal to an eleventh threshold (where the eleventh threshold may be equal to, for example, 2, 2.1, 2.5, 3, or another value), the ratio of the adaptive codebook gain of the current subframe of the foregoing current speech/audio frame to that of the subframe adjacent to the foregoing current subframe is greater than or equal to a twelfth threshold (where the twelfth threshold may be equal to, for example, 1, 1.1, 1.5, 2, 2.1, or another value), and the ratio of the algebraic codebook gain of the current subframe of the foregoing current speech/audio frame to that of the speech/audio frame previous to the foregoing current speech/audio frame is less than or equal to a thirteenth threshold (where the thirteenth threshold may be equal to, for example, 1, 1.1, 1.5, 2, or another value), the adaptive codebook gain of the current subframe of the foregoing current speech/audio frame may be augmented); or if the foregoing current speech/audio frame is a redundant decoded frame, or the foregoing current speech/audio frame is a normal decoded frame, and the speech/audio frame previous to the foregoing current speech/audio frame is a redundant decoded frame, and if the foregoing current speech/audio frame is voiced, the signal class of the speech/audio frame previous to the foregoing current speech/audio frame is generic, and an algebraic codebook gain of a subframe of the foregoing current speech/audio frame is greater than or equal to an algebraic codebook gain of a subframe previous to the foregoing subframe (for example, the algebraic codebook gain of the subframe of the foregoing current speech/audio frame may be 1 or more than 1 time, for example, 1, 1.5, 2, 2.5, 3, 3.4, or 4 times, the algebraic codebook gain of the subframe previous to the foregoing subframe), adjusting (attenuating or augmenting) an adaptive codebook gain of a current subframe of the foregoing current speech/audio frame based on at least one of a ratio of an algebraic codebook gain of the current subframe of the foregoing current speech/audio frame to that of a subframe adjacent to the foregoing current subframe, a ratio of the adaptive codebook gain of the current subframe of the foregoing current speech/audio frame to that of the subframe adjacent to the foregoing current subframe, or a ratio of the algebraic codebook gain of the current subframe of the foregoing current speech/audio frame to that of the speech/audio frame previous to the foregoing current speech/audio frame (for example, if the ratio of the algebraic codebook gain of the current subframe of the foregoing current speech/audio frame to that of the subframe adjacent to the foregoing current subframe is greater than or equal to an eleventh threshold (where the eleventh threshold is equal to, for example, 2, 2.1, 2.5, 3, or another value), the ratio of the adaptive codebook gain of the current subframe of the foregoing current speech/audio frame to that of the subframe adjacent to the foregoing current subframe is greater than or equal to a twelfth threshold (where the twelfth threshold is equal to, for example, 1, 1.1, 1.5, 2, 2.1, or another value), and the ratio of the algebraic codebook gain of the current subframe of the foregoing current speech/audio frame to that of the speech/audio frame previous to the foregoing current speech/audio frame is less than or equal to a thirteenth threshold (where the thirteenth threshold may be equal to, for example, 1, 1.1, 1.5, 2, or another value), the adaptive codebook gain of the current subframe of the foregoing current speech/audio frame may be augmented; or if the foregoing current speech/audio frame is a redundant decoded frame, or the foregoing current speech/audio frame is a normal decoded frame, and the speech/audio frame previous to the foregoing current speech/audio frame is a redundant decoded frame, and if the signal class of the foregoing current speech/audio frame is voiced, the signal class of the speech/audio frame previous to the foregoing current speech/audio frame is generic, and an algebraic codebook gain of a subframe of the foregoing current speech/audio frame is greater than or equal to an algebraic codebook gain of the speech/audio frame previous to the foregoing current speech/audio frame (for example, the algebraic codebook gain of the subframe of the foregoing current speech/audio frame is 1 or more than 1 time, for example, 1, 1.5, 2, 2.5, 3, 3.4, or 4 times, the algebraic codebook gain of the speech/audio frame previous to the foregoing current speech/audio frame), adjusting (attenuating or augmenting) an adaptive codebook gain of a current subframe of the foregoing current speech/audio frame based on at least one of a ratio of an algebraic codebook gain of the current subframe of the foregoing current speech/audio frame to that of a subframe adjacent to the foregoing current subframe, a ratio of the adaptive codebook gain of the current subframe of the foregoing current speech/audio frame to that of the subframe adjacent to the foregoing current subframe, or a ratio of the algebraic codebook gain of the current subframe of the foregoing current speech/audio frame to that of the speech/audio frame previous to the foregoing current speech/audio frame (for example, if the ratio of the algebraic codebook gain of the current subframe of the foregoing current speech/audio frame to that of the subframe adjacent to the foregoing current subframe is greater than or equal to an eleventh threshold (where the eleventh threshold may be equal to, for example, 2, 2.1, 2.5, 3, or another value), the ratio of the adaptive codebook gain of the current subframe of the foregoing current speech/audio frame to that of the subframe adjacent to the foregoing current subframe is greater than or equal to a twelfth threshold (where the twelfth threshold may be equal to, for example, 1, 1.1, 1.5, 2, 2.1, or another value), and the ratio of the algebraic codebook gain of the current subframe of the foregoing current speech/audio frame to that of the speech/audio frame previous to the foregoing current speech/audio frame is less than or equal to a thirteenth threshold (where the thirteenth threshold is equal to, for example, 1, 1.1, 1.5, 2, or another value), the adaptive codebook gain of the current subframe of the foregoing current speech/audio frame may be augmented.

In other embodiments of the present invention, the speech/audio decoding parameter of the foregoing current speech/audio frame includes the algebraic codebook of the foregoing current speech/audio frame, and the performing post processing on the speech/audio decoding parameter of the foregoing current speech/audio frame according to speech/audio parameters of X speech/audio frames, to obtain a post-processed speech/audio decoding parameter of the foregoing current speech/audio frame may include: performing post processing on the algebraic codebook of the foregoing current speech/audio frame according to at least one of the signal class, an algebraic codebook, or the spectrum tilt factor of the X speech/audio frames, to obtain a post-processed algebraic codebook of the foregoing current speech/audio frame.

For example, the performing post processing on the algebraic codebook of the foregoing current speech/audio frame according to at least one of the signal class, an algebraic codebook, or the spectrum tilt factor of the X speech/audio frames may include: if the foregoing current speech/audio frame is a redundant decoded frame, the signal class of the speech/audio frame next to the foregoing current speech/audio frame is unvoiced, the spectrum tilt factor of the speech/audio frame previous to the foregoing current speech/audio frame is less than or equal to an eighth threshold, and an algebraic codebook of a subframe of the foregoing current speech/audio frame is 0 or is less than or equal to a ninth threshold, using an algebraic codebook or a random noise of a subframe previous to the foregoing current speech/audio frame as an algebraic codebook of the foregoing current subframe.

The eighth threshold and the ninth threshold each may be set to different values according to different application environments or scenarios.

For example, the eighth threshold may be set to 0.16, 0.15, 0.165, 0.1, 0.161, or 0.159.

For example, the ninth threshold may be set to 0.1, 0.09, 0.11, 0.07, 0.101, 0.099, or another value close to 0.

The eighth threshold may be equal to or not equal to the second threshold.

In other embodiments of the present invention, the speech/audio decoding parameter of the foregoing current speech/audio frame includes a bandwidth extension envelope of the foregoing current speech/audio frame, and the performing post processing on the speech/audio decoding parameter of the foregoing current speech/audio frame according to speech/audio parameters of X speech/audio frames, to obtain a post-processed speech/audio decoding parameter of the foregoing current speech/audio frame may include: performing post processing on the bandwidth extension envelope of the foregoing current speech/audio frame according to at least one of the signal class, a bandwidth extension envelope, or the spectrum tilt factor of the X speech/audio frames, to obtain a post-processed bandwidth extension envelope of the foregoing current speech/audio frame.

For example, the performing post processing on the bandwidth extension envelope of the foregoing current speech/audio frame according to at least one of the signal class, a bandwidth extension envelope, or the spectrum tilt factor of the X speech/audio frames, to obtain a post-processed bandwidth extension envelope of the foregoing current speech/audio frame may include:

if the speech/audio frame previous to the foregoing current speech/audio frame is a normal decoded frame, and the signal class of the speech/audio frame previous to the foregoing current speech/audio frame is the same as that of the speech/audio frame next to the current speech/audio frame, obtaining the post-processed bandwidth extension envelope of the foregoing current speech/audio frame based on a bandwidth extension envelope of the speech/audio frame previous to the foregoing current speech/audio frame and the bandwidth extension envelope of the foregoing current speech/audio frame; or if the foregoing current speech/audio frame is a prediction form of redundancy decoding, obtaining the post-processed bandwidth extension envelope of the foregoing current speech/audio frame based on a bandwidth extension envelope of the speech/audio frame previous to the foregoing current speech/audio frame and the bandwidth extension envelope of the foregoing current speech/audio frame; or if the signal class of the foregoing current speech/audio frame is not unvoiced, the signal class of the speech/audio frame next to the foregoing current speech/audio frame is unvoiced, the spectrum tilt factor of the speech/audio frame previous to the foregoing current speech/audio frame is less than or equal to a tenth threshold, modifying the bandwidth extension envelope of the foregoing current speech/audio frame according to a bandwidth extension envelope or the spectrum tilt factor of the speech/audio frame previous to the foregoing current speech/audio frame, to obtain the post-processed bandwidth extension envelope of the foregoing current speech/audio frame.

The tenth threshold may be set to different values according to different application environments or scenarios. For example, the tenth threshold may be set to 0.16, 0.15, 0.165, 0.1, 0.161, or 0.159.

For example, the obtaining the post-processed bandwidth extension envelope of the foregoing current speech/audio frame based on a bandwidth extension envelope of the speech/audio frame previous to the foregoing current speech/audio frame and the bandwidth extension envelope of the foregoing current speech/audio frame may include: specifically obtaining the post-processed bandwidth extension envelope of the foregoing current speech/audio frame based on the bandwidth extension envelope of the speech/audio frame previous to the foregoing current speech/audio frame and the bandwidth extension envelope of the foregoing current speech/audio frame and by using the following formula:

$$GainFrame=fac1*GainFrame_old+fac2*GainFrame_new, \text{ where}$$

GainFrame is the post-processed bandwidth extension envelope of the foregoing current speech/audio frame, GainFrame_old the bandwidth extension envelope of the speech/audio frame previous to the foregoing current speech/audio frame, Gainframe_new is the bandwidth extension envelope of the foregoing current speech/audio frame, fac1 is a weight of the bandwidth extension envelope of the speech/audio frame previous to the foregoing current speech/audio frame, fac2 is a weight of the bandwidth extension envelope of the foregoing current speech/audio frame, $fac1 \geq 0$, $fac2 \geq 0$, and $fac1+fac2=1$.

For another example, a modification factor for modifying the bandwidth extension envelope of the foregoing current speech/audio frame is inversely proportional to the spectrum tilt factor of the speech/audio frame previous to the foregoing current speech/audio frame, and is proportional to a ratio of the bandwidth extension envelope of the speech/audio frame previous to the foregoing current speech/audio frame to the bandwidth extension envelope of the foregoing current speech/audio frame.

In other embodiments of the present invention, the speech/audio decoding parameter of the foregoing current speech/audio frame includes a pitch period of the foregoing current speech/audio frame, and the performing post processing on the speech/audio decoding parameter of the foregoing current speech/audio frame according to speech/audio parameters of X speech/audio frames, to obtain a post-processed speech/audio decoding parameter of the foregoing current speech/audio frame may include: performing post processing on the pitch period of the foregoing current speech/audio frame according to the signal classes and/or pitch periods of the X speech/audio frames (for example, post processing such as augmentation or attenuation may be performed on the pitch period of the foregoing current speech/audio frame according to the signal classes and/or the pitch periods of the X speech/audio frames), to obtain a post-processed pitch period of the foregoing current speech/audio frame.

It can be learned from the foregoing description that in some embodiments of the present invention, during transition between an unvoiced speech/audio frame and a non-unvoiced speech/audio frame (for example, when a current speech/audio frame is of an unvoiced signal class and is a redundant decoded frame, and a speech/audio frame previous or next to the current speech/audio frame is of a non unvoiced signal type and is a normal decoded frame, or when a current speech/audio frame is of a non unvoiced signal class and is a normal decoded frame, and a speech/audio frame previous or next to the current speech/audio frame is of an unvoiced signal class and is a redundant decoded frame), post processing is performed on a speech/audio decoding parameter of the current speech/audio frame, which helps avoid a click (click) phenomenon caused during the interframe transition between the unvoiced speech/audio frame and the non-unvoiced speech/audio frame, thereby improving quality of an output speech/audio signal.

In other embodiments of the present invention, during transition between a generic speech/audio frame and a voiced speech/audio frame (when a current speech/audio frame is a generic frame and is a redundant decoded frame, and a speech/audio frame previous or next to the current speech/audio frame is of a voiced signal class and is a normal decoded frame, or when a current speech/audio frame is of a voiced signal class and is a normal decoded frame, and a speech/audio frame previous or next to the current speech/audio frame is of a generic signal class and is a redundant decoded frame), post processing is performed on a speech/audio decoding parameter of the current speech/audio frame, which helps rectify an energy instability phenomenon caused during the transition between a generic frame and a voiced frame, thereby improving quality of an output speech/audio signal.

In still other embodiments of the present invention, when a current speech/audio frame is a redundant decoded frame, a signal class of the current speech/audio frame is not unvoiced, and a signal class of a speech/audio frame next to the current speech/audio frame is unvoiced, a bandwidth extension envelope of the current frame is adjusted, to rectify an energy instability phenomenon in time-domain bandwidth extension, and improve quality of an output speech/audio signal.

To help better understand and implement the foregoing solution in this embodiment of the present invention, some specific application scenarios are used as examples in the following description.

Figure 2:
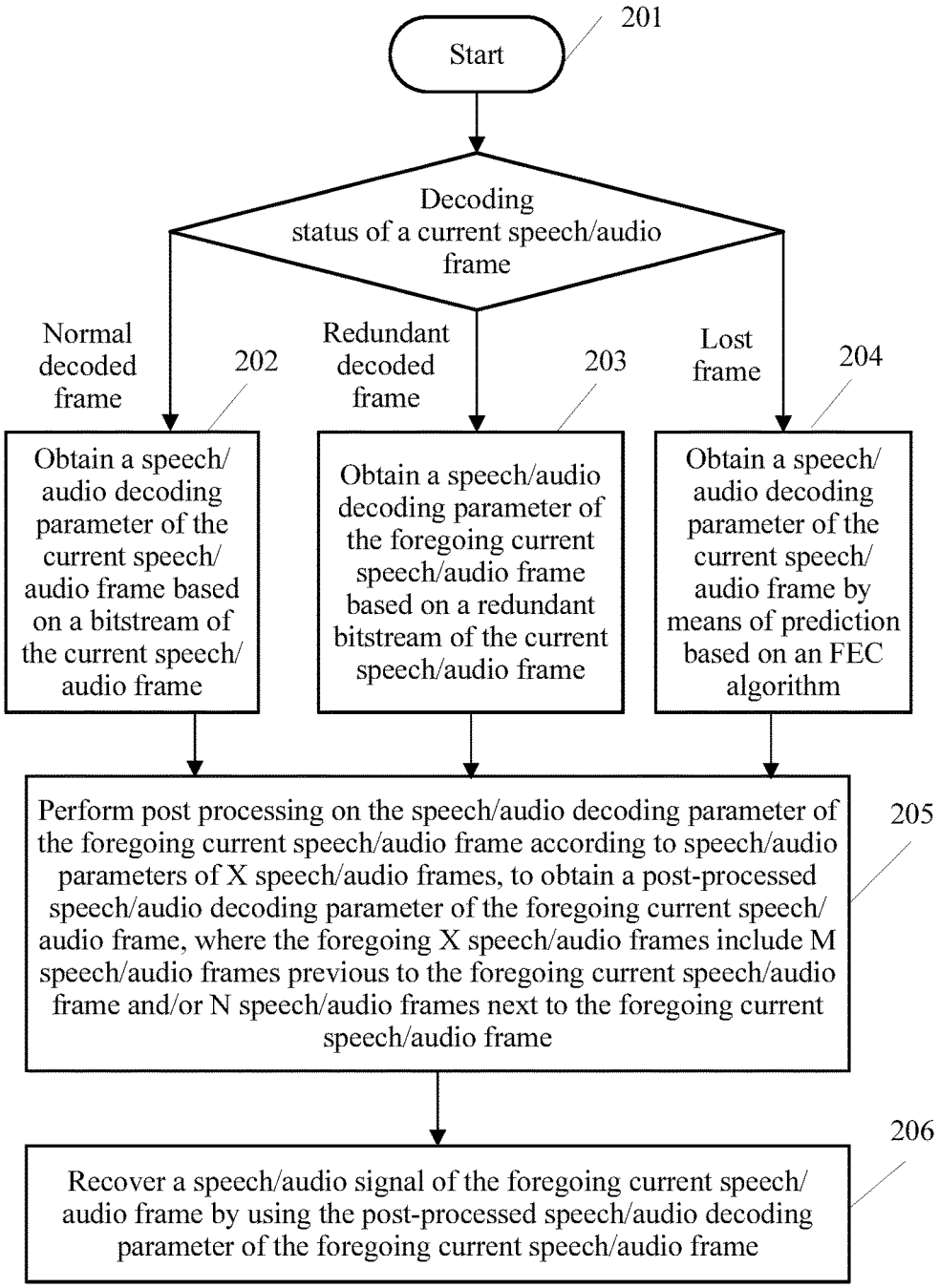
FIG. 2 is a schematic flowchart of another speech/audio bitstream decoding method according to an embodiment of the present invention.

Referring to FIG. 2, FIG. 2 is a schematic flowchart of another speech/audio bitstream decoding method according to another embodiment of the present invention. The another speech/audio bitstream decoding method provided in the another embodiment of the present invention may include the following content:

201. Determine a decoding status of a current speech/audio frame.

Specifically, for example, it may be determined, based on a JBM algorithm or another algorithm, that the current speech/audio frame is a normal decoded frame, a redundant decoded frame, or an FEC recovered frame.

If the current speech/audio frame is a normal decoded frame, and a speech/audio frame previous to the current speech/audio frame is a redundant decoded frame, step 202 is executed.

If the current speech/audio frame is a redundant decoded frame, step 203 is executed.

If the current speech/audio frame is an FEC recovered frame, and a speech/audio frame previous to the foregoing current speech/audio frame is a redundant decoded frame, step 204 is executed.

202. Obtain a speech/audio decoding parameter of the current speech/audio frame based on a bitstream of the current speech/audio frame, and jump to step 205.

203. Obtain a speech/audio decoding parameter of the foregoing current speech/audio frame based on a redundant bitstream of the current speech/audio frame, and jump to step 205.

204. Obtain a speech/audio decoding parameter of the current speech/audio frame by means of prediction based on an FEC algorithm, and jump to step 205.

205. Perform post processing on the speech/audio decoding parameter of the foregoing current speech/audio frame according to speech/audio parameters of X speech/audio frames, to obtain a post-processed speech/audio decoding parameter of the foregoing current speech/audio frame, where the foregoing X speech/audio frames include M speech/audio frames previous to the foregoing current speech/audio frame and/or N speech/audio frames next to the foregoing current speech/audio frame, and M and N are positive integers.

206. Recover a speech/audio signal of the foregoing current speech/audio frame by using the post-processed speech/audio decoding parameter of the foregoing current speech/audio frame.

Different post processing may be performed on different speech/audio decoding parameters. For example, post processing performed on a spectral pair parameter of the current speech/audio frame may be adaptive weighting performed by using the spectral pair parameter of the current speech/audio frame and a spectral pair parameter of the speech/audio frame previous to the current speech/audio frame, to obtain a post-processed spectral pair parameter of the current speech/audio frame, and post processing performed on an adaptive codebook gain of the current speech/audio frame may be adjustment such as attenuation performed on the adaptive codebook gain.

It may be understood that the details about performing post processing on the speech/audio decoding parameter in this embodiment may refer to related descriptions of the foregoing method embodiments, and details are not described herein.

It can be learned from the foregoing description that in this embodiment, in a scenario in which a current speech/audio frame is a redundant decoded frame or a speech/audio frame previous to the foregoing current speech/audio frame is a redundant decoded frame, after obtaining a speech/audio decoding parameter of the current speech/audio frame, a decoder performs post processing on the speech/audio decoding parameter of the current speech/audio frame according to speech/audio parameters of X speech/audio frames, to obtain a post-processed speech/audio decoding parameter of the foregoing current speech/audio frame, where the foregoing X speech/audio frames include M speech/audio frames previous to the foregoing current speech/audio frame and/or N speech/audio frames next to the foregoing current speech/audio frame, and recovers a speech/audio signal of the current speech/audio frame by using the post-processed speech/audio decoding parameter of the current speech/audio frame, which ensures stable quality of a decoded signal during transition between a redundant decoded frame and a normal decoded frame or between a redundant decoded frame and an FEC recovered frame, thereby improving quality of an output speech/audio signal.

It can be learned from the foregoing description that in some embodiments of the present invention, during transition between an unvoiced speech/audio frame and a non-unvoiced speech/audio frame (for example, when a current speech/audio frame is of an unvoiced signal class and is a redundant decoded frame, and a speech/audio frame previous or next to the current speech/audio frame is of a non unvoiced signal type and is a normal decoded frame, or when a current speech/audio frame is of a non unvoiced signal class and is a normal decoded frame, and a speech/audio frame previous or next to the current speech/audio frame is of an unvoiced signal class and is a redundant decoded frame), post processing is performed on a speech/audio decoding parameter of the current speech/audio frame, which helps avoid a click (click) phenomenon caused during the interframe transition between the unvoiced speech/audio frame and the non-unvoiced speech/audio frame, thereby improving quality of an output speech/audio signal.

In other embodiments of the present invention, during transition between a generic speech/audio frame and a voiced speech/audio frame (when a current speech/audio frame is a generic frame and is a redundant decoded frame, and a speech/audio frame previous or next to the current speech/audio frame is of a voiced signal class and is a normal decoded frame, or when a current speech/audio frame is of a voiced signal class and is a normal decoded frame, and a speech/audio frame previous or next to the current speech/audio frame is of a generic signal class and is a redundant decoded frame), post processing is performed on a speech/audio decoding parameter of the current speech/audio frame, which helps rectify an energy instability phenomenon caused during the transition between a generic frame and a voiced frame, thereby improving quality of an output speech/audio signal.

In still other embodiments of the present invention, when a current speech/audio frame is a redundant decoded frame, a signal class of the current speech/audio frame is not unvoiced, and a signal class of a speech/audio frame next to the current speech/audio frame is unvoiced, a bandwidth extension envelope of the current frame is adjusted, to rectify an energy instability phenomenon in time-domain bandwidth extension, and improve quality of an output speech/audio signal.

An embodiment of the present invention further provides a related apparatus for implementing the foregoing solution.

Figure 3:
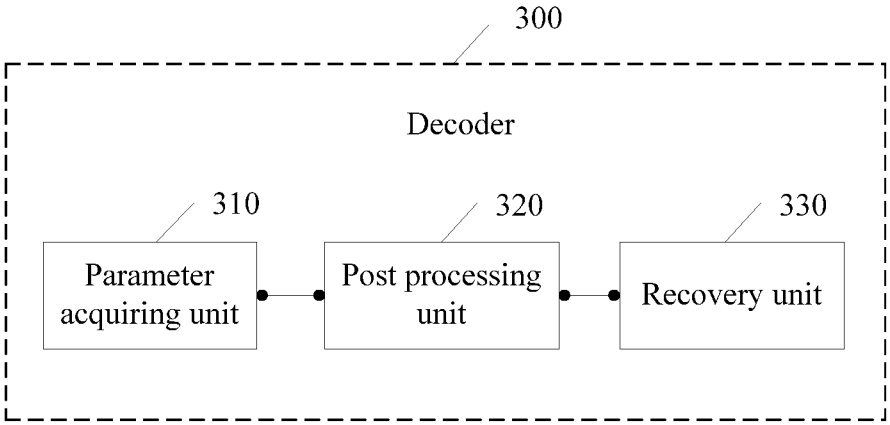
FIG. 3 is a schematic diagram of a decoder according to an embodiment of the present invention.

Referring to FIG. 3, an embodiment of the present invention provides a decoder 300 for decoding a speech/audio bitstream, which may include: a parameter acquiring unit 310, a post processing unit 320, and a recovery unit 330.

The parameter acquiring unit 310 is configured to acquire a speech/audio decoding parameter of a current speech/audio frame, where the foregoing current speech/audio frame is a redundant decoded frame or a speech/audio frame previous to the foregoing current speech/audio frame is a redundant decoded frame.

When the speech/audio frame previous to the foregoing current speech/audio frame is a redundant decoded frame, the current speech/audio frame may be a normal decoded frame, a redundant decoded frame, or an FEC recovery frame.

The post processing unit 320 is configured to perform post processing on the speech/audio decoding parameter of the foregoing current speech/audio frame according to speech/audio parameters of X speech/audio frames, to obtain a post-processed speech/audio decoding parameter of the foregoing current speech/audio frame, where the foregoing X speech/audio frames include M speech/audio frames previous to the foregoing current speech/audio frame and/or N speech/audio frames next to the foregoing current speech/audio frame, and M and N are positive integers.

The recovery unit 330 is configured to recover a speech/audio signal of the foregoing current speech/audio frame by using the post-processed speech/audio decoding parameter of the foregoing current speech/audio frame.

That a speech/audio frame (for example, the current speech/audio frame or the speech/audio frame previous to the current speech/audio frame) is a normal decoded frame means that a speech/audio parameter, and the like of the foregoing speech/audio frame can be directly obtained from a bitstream of the speech/audio frame by means of decoding. That a speech/audio frame (for example, the current speech/audio frame or the speech/audio frame previous to the current speech/audio frame) is a redundant decoded frame means that a speech/audio parameter, and the like of the speech/audio frame cannot be directly obtained from a bitstream of the speech/audio frame by means of decoding, but redundant bitstream information of the speech/audio frame can be obtained from a bitstream of another speech/audio frame.

The M speech/audio frames previous to the current speech/audio frame refer to M speech/audio frames preceding the current speech/audio frame and immediately adjacent to the current speech/audio frame in a time domain.

For example, M may be equal to 1, 2, 3, or another value. When M=1, the M speech/audio frames previous to the current speech/audio frame are the speech/audio frame previous to the current speech/audio frame, and the speech/audio frame previous to the current speech/audio frame and the current speech/audio frame are two immediately adjacent speech/audio frames; when M=2, the M speech/audio frames previous to the current speech/audio frame are the speech/audio frame previous to the current speech/audio frame and a speech/audio frame previous to the speech/audio frame previous to the current speech/audio frame, and the speech/audio frame previous to the current speech/audio frame, the speech/audio frame previous to the speech/audio frame previous to the current speech/audio frame, and the current speech/audio frame are three immediately adjacent speech/audio frames; and so on.

The N speech/audio frames next to the current speech/audio frame refer to N speech/audio frames following the current speech/audio frame and immediately adjacent to the current speech/audio frame in a time domain.

For example, N may be equal to 1, 2, 3, 4, or another value. When N=1, the N speech/audio frames next to the current speech/audio frame are a speech/audio frame next to the current speech/audio frame, and the speech/audio frame next to the current speech/audio frame and the current speech/audio frame are two immediately adjacent speech/audio frames; when N=2, the N speech/audio frames next to the current speech/audio frame are a speech/audio frame next to the current speech/audio frame and a speech/audio frame next to the speech/audio frame next to the current speech/audio frame, and the speech/audio frame next to the current speech/audio frame, the speech/audio frame next to the speech/audio frame next to the current speech/audio frame, and the current speech/audio frame are three immediately adjacent speech/audio frames; and so on.

The speech/audio decoding parameter may include at least one of the following parameters:

a bandwidth extension envelope, an adaptive codebook gain (gain_pit), an algebraic codebook, a pitch period, a spectrum tilt factor, a spectral pair parameter, and the like.

The speech/audio parameter may include a speech/audio decoding parameter, a signal class, and the like.

A signal class of a speech/audio frame may be unvoiced, voiced, generic, transient, inactive, or the like.

The spectral pair parameter may be, for example, at least one of a line spectral pair (LSP) parameter or an immittance spectral pair (ISP) parameter.

It may be understood that in this embodiment of the present invention, the post processing unit 320 may perform post processing on at least one speech/audio decoding parameter of a bandwidth extension envelope, an adaptive codebook gain, an algebraic codebook, a pitch period, or a spectral pair parameter of the current speech/audio frame. Specifically, how many parameters are selected and which parameters are selected for post processing may be determined according to an application scenario and an application environment, which is not limited in this embodiment of the present invention.

The post processing unit 320 may perform different post processing on different speech/audio decoding parameters. For example, post processing performed by the post processing unit 320 on the spectral pair parameter of the current speech/audio frame may be adaptive weighting performed by using the spectral pair parameter of the current speech/audio frame and a spectral pair parameter of the speech/audio frame previous to the current speech/audio frame, to obtain a post-processed spectral pair parameter of the current speech/audio frame, and post processing performed by the post processing unit 320 on the adaptive codebook gain of the current speech/audio frame may be adjustment such as attenuation performed on the adaptive codebook gain.

It may be understood that functions of function modules of the decoder 300 in this embodiment may be specifically implemented according to the method in the foregoing method embodiment. For a specific implementation process, refer to related descriptions of the foregoing method embodiment. Details are not described herein. The decoder 300 may be any apparatus that needs to output speeches, for example, a device such as a notebook computer, a tablet computer, or a personal computer, or a mobile phone.

Figure 4:
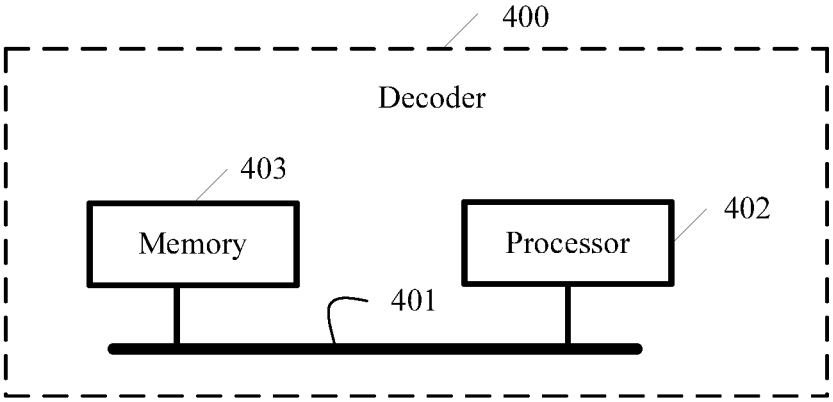
FIG. 4 is a schematic diagram of another decoder according to an embodiment of the present invention.

FIG. 4 is a schematic diagram of a decoder 400 according to an embodiment of the present invention. The decoder 400 may include at least one bus 401, at least one processor 402 connected to the bus 401, and at least one memory 403 connected to the bus 401.

By invoking, by using the bus 401, code stored in the memory 403, the processor 402 is configured to perform the steps as described in the previous method embodiments, and the specific implementation process of the processor 402 can refer to related descriptions of the foregoing method embodiments. Details are not described herein.

It may be understood that in this embodiment of the present invention, by invoking the code stored in the memory 403, the processor 402 may be configured to perform post processing on at least one speech/audio decoding parameter of a bandwidth extension envelope, an adaptive codebook gain, an algebraic codebook, a pitch period, or a spectral pair parameter of the current speech/audio frame. Specifically, how many parameters are selected and which parameters are selected for post processing may be determined according to an application scenario and an application environment, which is not limited in this embodiment of the present invention.

Different post processing may be performed on different speech/audio decoding parameters. For example, post processing performed on the spectral pair parameter of the current speech/audio frame may be adaptive weighting performed by using the spectral pair parameter of the current speech/audio frame and a spectral pair parameter of the speech/audio frame previous to the current speech/audio frame, to obtain a post-processed spectral pair parameter of the current speech/audio frame, and post processing performed on the adaptive codebook gain of the current speech/audio frame may be adjustment such as attenuation performed on the adaptive codebook gain.

A specific post processing manner is not limited in this embodiment of the present invention, and specific post processing may be set according to a requirement or according to an application environment and an application scenario.

Figure 5:
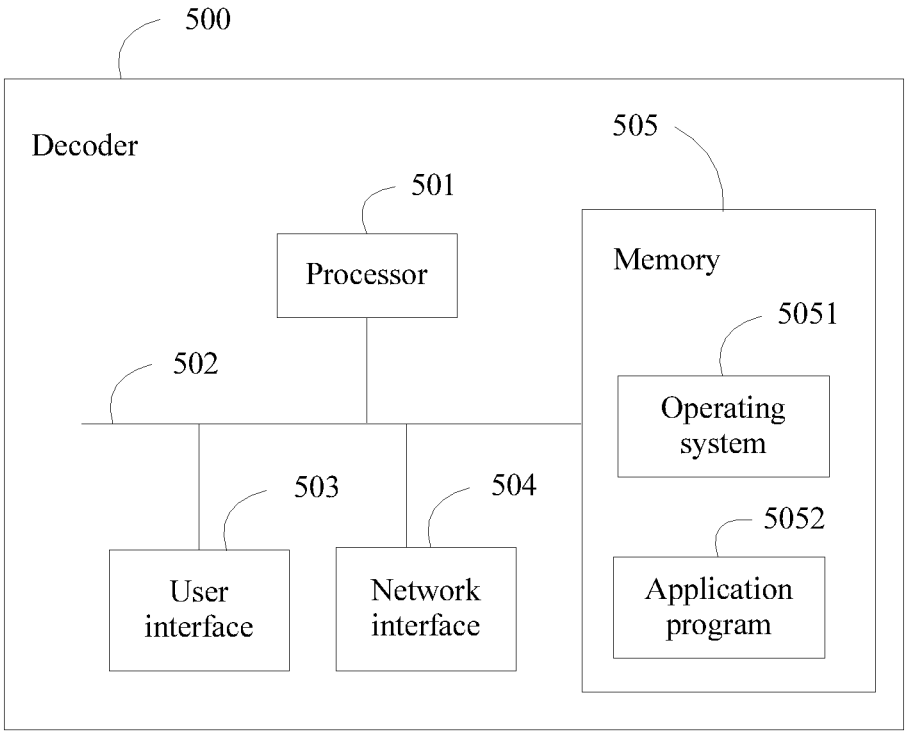
FIG. 5 is a schematic diagram of another decoder according to an embodiment of the present invention.

Referring to FIG. 5, FIG. 5 is a structural block diagram of a decoder 500 according to another embodiment of the present invention. The decoder 500 may include at least one processor 501, at least one network interface 504 or user interface 503, a memory 505, and at least one communications bus 502. The communication bus 502 is configured to implement connection and communication between these components. The decoder 500 may optionally include the user interface 503, which includes a display (for example, a touchscreen, an LCD, a CRT, a holographic device, or a projector (Projector)), a click/tap device (for example, a mouse, a trackball (trackball), a touchpad, or a touchscreen), a camera and/or a pickup apparatus, and the like.

The memory 505 may include a read-only memory and a random access memory, and provide an instruction and data for the processor 501. A part of the memory 505 may further include a nonvolatile random access memory (NVRAM).

In some implementation manners, the memory 505 stores the following elements, an executable module or a data structure, or a subset thereof, or an extended set thereof:

an operating system 5051, including various system programs, and used to implement various basic services and process hardware-based tasks; and an application program module 5052, including various application programs, and configured to implement various application services.

The application program module 5052 includes but is not limited to a parameter acquiring unit 310, a post processing unit 320, a recovery unit 330, and the like.

In this embodiment of the present invention, by invoking a program or an instruction stored in the memory 505, the processor 501 may be configured to perform the steps as described in the previous method embodiments.

It may be understood that in this embodiment, by invoking the program or the instruction stored in the memory 505, the processor 501 may perform post processing on at least one speech/audio decoding parameter of a bandwidth extension envelope, an adaptive codebook gain, an algebraic codebook, a pitch period, or a spectral pair parameter of the current speech/audio frame. Specifically, how many parameters are selected and which parameters are selected for post processing may be determined according to an application scenario and an application environment, which is not limited in this embodiment of the present invention.

Different post processing may be performed on different speech/audio decoding parameters. For example, post processing performed on the spectral pair parameter of the current speech/audio frame may be adaptive weighting performed by using the spectral pair parameter of the current speech/audio frame and a spectral pair parameter of the speech/audio frame previous to the current speech/audio frame, to obtain a post-processed spectral pair parameter of the current speech/audio frame, and post processing performed on the adaptive codebook gain of the current speech/audio frame may be adjustment such as attenuation performed on the adaptive codebook gain. The specific implementation details about the post processing can refer to related descriptions of the foregoing method embodiments An embodiment of the present invention further provides a computer storage medium, where the computer storage medium may store a program. When being executed, the program includes some or all steps of any speech/audio bitstream decoding method described in the foregoing method embodiments.

It should be noted that, to make the description brief, the foregoing method embodiments are expressed as a series of actions. However, persons skilled in the art should appreciate that the present invention is not limited to the described action sequence, because according to the present invention, some steps may be performed in other sequences or performed simultaneously.

In the foregoing embodiments, the description of each embodiment has respective focuses. For a part that is not described in detail in an embodiment, refer to related descriptions in other embodiments.

In the several embodiments provided in this application, it should be understood that the disclosed apparatus may be implemented in another manner. For example, the described apparatus embodiment is merely exemplary. For example, the unit division is merely logical function division and may be other division in actual implementation. For example, multiple units or components may be combined or integrated into another system, or some features may be ignored or not performed. In addition, the displayed or discussed mutual couplings or direct couplings or communication connections may be implemented through some interfaces. The indirect couplings or communication connections between the apparatuses or units may be implemented in electronic or other forms.

The units described as separate parts may or may not be physically separate, and parts displayed as units may or may not be physical units, may be located in one position, or may be distributed on multiple network units. Some or all of the units may be selected according to actual needs to achieve the objectives of the solutions of the embodiments.

In addition, functional units in the embodiments of the present invention may be integrated into one processing unit, or each of the units may exist alone physically, or two or more units are integrated into one unit. The integrated unit may be implemented in a form of hardware, or may be implemented in a form of a software functional unit.

When the integrated unit is implemented in the form of a software functional unit and sold or used as an independent product, the integrated unit may be stored in a computer-readable storage medium. Based on such an understanding, the technical solutions of the present invention essentially, or the part contributing to the prior art, or all or a part of the technical solutions may be implemented in the form of a software product. The software product is stored in a storage medium and includes several instructions for instructing a computer device (which may be a personal computer, a server, or a network device, and may specifically be a processor in a computer device) to perform all or a part of the steps of the foregoing methods described in the embodiments of the present invention. The foregoing storage medium may include: any medium that can store program code, such as a USB flash drive, a magnetic disk, a random access memory (RAM, random access memory), a read-only memory (ROM, read-only memory), a removable hard disk, or an optical disc.

The foregoing embodiments are merely intended for describing the technical solutions of the present invention, but not for limiting the present invention. Although the present invention is described in detail with reference to the foregoing embodiments, persons of ordinary skill in the art should understand that they may still make modifications to the technical solutions described in the foregoing embodiments or make equivalent replacements to some technical features thereof, without departing from the scope of the technical solutions of the embodiments of the present invention.

The invention claimed is:

1. An audio bitstream decoding method implemented by a decoder, comprising:

acquiring, by a network interface of the decoder, a decoding parameter of a frame from an input audio bitstream, wherein the frame is a redundant decoded frame that is recovered based on redundant bitstream information from another frame when the frame is a lost frame, or a previous frame adjacent to the frame that is a redundant decoded frame, and the decoding parameter comprises an adaptive codebook gain;

adjusting, by a processor of the decoder, the adaptive codebook gain of the frame according to a signal class, an algebraic codebook gain, or an adaptive codebook gain of X frames of the audio bitstream, to obtain an adjusted adaptive codebook gain of the frame, wherein the X frames comprise M frames previous to the frame and/or N frames next to the frame, and wherein X, M and N are positive integers;

recovering, by the processor of the decoder, a signal of the frame according to the adjusted adaptive codebook gain of the frame; and outputting an audio signal synthesized according to the recovered signal.

2. The method according to claim 1, wherein adjusting the adaptive codebook gain comprises:

attenuating an adaptive codebook gain of a subframe of the frame, wherein the frame is a redundant decoded frame, a signal class of the frame is not unvoiced, a signal class of at least one of two frames next to the frame is unvoiced, and an algebraic codebook gain of the subframe is greater than or equal to an algebraic codebook gain of the previous frame adjacent to the frame.

3. The method according to claim 1, wherein adjusting the adaptive codebook gain comprises:

attenuating an adaptive codebook gain of a subframe of the frame, wherein the frame is a redundant decoded frame, the signal class of the frame is not unvoiced, the signal class of at least one of two frames next to the frame is unvoiced, and the algebraic codebook gain of the subframe is greater than or equal to an algebraic codebook gain of a previous subframe adjacent to the subframe.

4. The method according to claim 1, wherein the decoding parameter of the frame further comprises an algebraic codebook, and wherein the method further comprises:

performing post processing on the algebraic codebook of the frame according to a signal class, an algebraic codebook, or a spectrum tilt factor of the X frames, to obtain a post-processed algebraic codebook of the frame.

5. The method according to claim 1, wherein the decoding parameter of the frame further comprises a bandwidth extension envelope, and wherein the method further comprises:

performing post processing on the bandwidth extension envelope of the frame according to a signal class, a bandwidth extension envelope, or a spectrum tilt factor of the X frames, to obtain a post-processed bandwidth extension envelope of the frame.

6. The method according to claim 5, wherein the previous frame adjacent to the frame is a normal decoded frame, a signal class of the previous frame adjacent to the frame is the same as that of a next frame adjacent to the frame, and wherein the performing post processing on the bandwidth extension envelope of the frame comprises:

obtaining the post-processed bandwidth extension envelope of the frame based on a bandwidth extension envelope of the previous frame adjacent to the frame and the bandwidth extension envelope of the frame.

7. The method according to claim 6, wherein a signal class of the frame is not unvoiced, a signal class of the next frame adjacent to the frame is unvoiced, and a spectrum tilt factor of the previous frame adjacent to the frame is less than or equal to a tenth threshold, and the method further comprises: modifying the bandwidth extension envelope of the frame according to the bandwidth extension envelope or the spectrum tilt factor of the previous frame adjacent to the frame, to obtain the post-processed bandwidth extension envelope of the frame.

8. The method according to claim 7, wherein a modification factor for modifying the bandwidth extension envelope of the frame is inversely proportional to the spectrum tilt factor of the previous frame adjacent to the frame, and is proportional to a ratio of the bandwidth extension envelope of the previous frame adjacent to the frame to the bandwidth extension envelope of the frame.

9. The method according claim 1, wherein the decoding parameter of the frame further comprises a pitch period, and wherein the method further comprises: performing post processing on the pitch period of the frame according to the signal class or a pitch period of the X frames, to obtain a post-processed pitch period of the frame.

10. A decoder for decoding an audio bitstream, comprising: a memory storing instructions, and a processor coupled to the memory to executes the instructions, the processor configured to:

acquire, via an interface, a decoding parameter of a frame from the audio bitstream, wherein the frame is a redundant decoded frame that is recovered based on redundant bitstream information from another frame when the frame is a lost frame, or a previous frame adjacent to the frame that is a redundant decoded frame, and wherein the decoding parameter comprises an adaptive codebook gain;

adjust the adaptive codebook gain of the frame according to a signal class, an algebraic codebook gain, or an adaptive codebook gain of X frames of the audio bitstream when the frame is a redundant decoded frame or a previous frame adjacent to the frame is a redundant decoded frame, to obtain an adjusted adaptive codebook gain of the frame, wherein the X frames comprise M frames previous to the frame and/or N frames next to the frame, and wherein X, M and N are positive integers;

recover a signal of the frame according to the adjusted adaptive codebook gain of the frame; and output, via the interface, an audio signal synthesized according to the recovered signal.

11. The decoder according to claim 10, wherein the processor is configured to: attenuating an adaptive codebook gain of a subframe of the frame when the frame is a redundant decoded frame, a signal class of the frame is not unvoiced, a signal class of at least one of two frames next to the frame is unvoiced, and an algebraic codebook gain of the subframe is greater than or equal to an algebraic codebook gain of the previous frame adjacent to the frame.

12. The decoder according to claim 10, wherein the processor is further configured to: attenuate an adaptive codebook gain of a subframe of the frame when the frame is a redundant decoded frame, the signal class of the frame is not unvoiced, the signal class of at least one of two frames next to the frame is unvoiced, and the algebraic codebook gain of the subframe is greater than or equal to an algebraic codebook gain of a previous subframe adjacent to the subframe.

13. The decoder according to claim 10, wherein the decoding parameter of the frame further comprises a bandwidth extension envelope, and the processor is further configured to: perform post processing on the bandwidth extension envelope of the frame to obtain a post-processed bandwidth extension envelope of the frame, wherein the post processing is performed according to a signal class, a bandwidth extension envelope, or a spectrum tilt factor of the X frames.

14. The decoder according to claim 10, wherein the processor is configured to:

obtain the post-processed bandwidth extension envelope of the frame when the previous frame adjacent to the frame is a normal decoded frame, and the signal class of the previous frame adjacent to the frame is the same as that of a next frame adjacent to the frame, wherein the post-processed bandwidth extension envelope of the frame is obtained based on a bandwidth extension envelope of the previous frame adjacent to the frame and the bandwidth extension envelope of the frame.

15. The decoder according to claim 14, wherein the processor is further configured to: modify the bandwidth extension envelope of the frame when a signal class of the frame is not unvoiced, a signal class of the next frame adjacent to the frame is unvoiced, and a spectrum tilt factor of the previous frame adjacent to the frame is less than or equal to a tenth threshold, wherein the bandwidth extension envelope of the frame is modified according to the bandwidth extension envelope or the spectrum tilt factor of the previous frame adjacent to the frame, to obtain the post-processed bandwidth extension envelope of the frame.

16. The decoder according to claim 15, wherein a modification factor used by the processor for modifying the bandwidth extension envelope of the frame is inversely proportional to the spectrum tilt factor of the previous frame adjacent to the frame, and is proportional to a ratio of the bandwidth extension envelope of the previous frame adjacent to the frame to the bandwidth extension envelope of the frame.

17. The decoder according to claim 10, wherein the decoding parameter of the frame further comprises a pitch period, and the processor is further configured to: perform post processing on the pitch period of the frame according to at least one of the signal class or a pitch period of the X frames, to obtain a post-processed pitch period of the frame.

* * * * *